United States Patent [19]

Nakao et al.

[11] Patent Number: 4,742,869

[45] Date of Patent: May 10, 1988

[54] HEAT AND MASS TRANSFER DEVICE

[75] Inventors: Kazushige Nakao; Masaki Ikeuchi; Tsuneo Yumikura; Eiichi Ozaki, all of Amagasaki, Japan

[73] Assignee: Mitsubishi Denki Kabushiki Kaisha, Tokyo, Japan

[21] Appl. No.: 921,182

[22] Filed: Oct. 21, 1986

[30] Foreign Application Priority Data

Oct. 21, 1985 [JP] Japan ..... 60-235704

[51] Int. Cl.[4] ..... A23C 3/04

[52] U.S. Cl. ..... 165/115; 165/184; 261/153

[58] Field of Search ..... 165/184, 115, 118; 261/153, 156

[56] References Cited

U.S. PATENT DOCUMENTS

| | | | |
|---|---|---|---|
| 242,300 | 5/1881 | Gold | 165/184 |
| 1,932,610 | 10/1933 | Tilley | 165/184 |
| 3,134,166 | 5/1964 | Venables, III | 165/184 X |
| 4,545,428 | 10/1985 | Onishi et al. | 165/184 X |

FOREIGN PATENT DOCUMENTS

| | | | |
|---|---|---|---|
| 1107259 | 5/1961 | Fed. Rep. of Germany . | |
| 1108716 | 1/1962 | Fed. Rep. of Germany . | |
| 1129170 | 11/1962 | Fed. Rep. of Germany . | |
| 1950246 | 10/1970 | Fed. Rep. of Germany . | |
| 2131085 | 12/1971 | Fed. Rep. of Germany . | |
| 54-14050 | 2/1979 | Japan | 165/184 |
| 55-43310 | 3/1980 | Japan | 165/184 |
| 235639 | 12/1944 | Switzerland . | |

*Primary Examiner*—Albert W. Davis, Jr.
*Assistant Examiner*—R. R. Cole
*Attorney, Agent, or Firm*—Sughrue, Mion, Zinn, Macpeak, and Seas

[57] ABSTRACT

A heat and mass transfer device for transmitting heat between a fluid flowing within a pipe and a solution flowing on the outside of the pipe. The device comprises at least one vertically upright tubular pipe and a U-shaped folded metal fin strip twisted helically around the periphery of the pipe. The spacing of the fins on the pipe is such that a pulsating flow of the solution flowing on the outside of the pipe is achieved.

6 Claims, 4 Drawing Sheets

FIG. 1
PRIOR ART
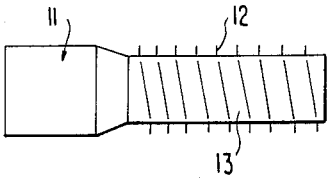
FIG. 2
PRIOR ART
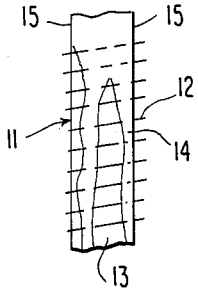
FIG. 3
PRIOR ART
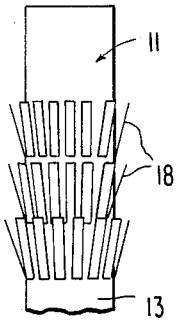
FIG. 4
PRIOR ART
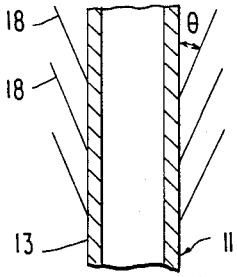
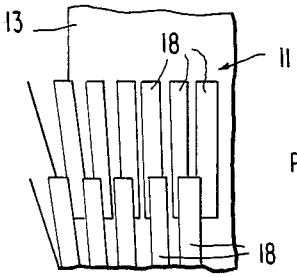
FIG. 5
PRIOR ART
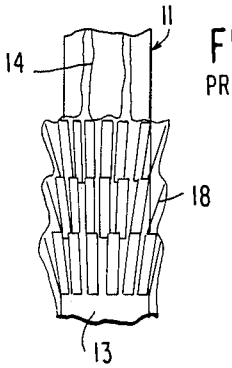
FIG. 6
PRIOR ART
FIG. 7
PRIOR ART
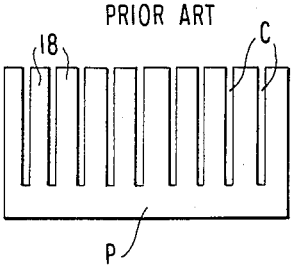
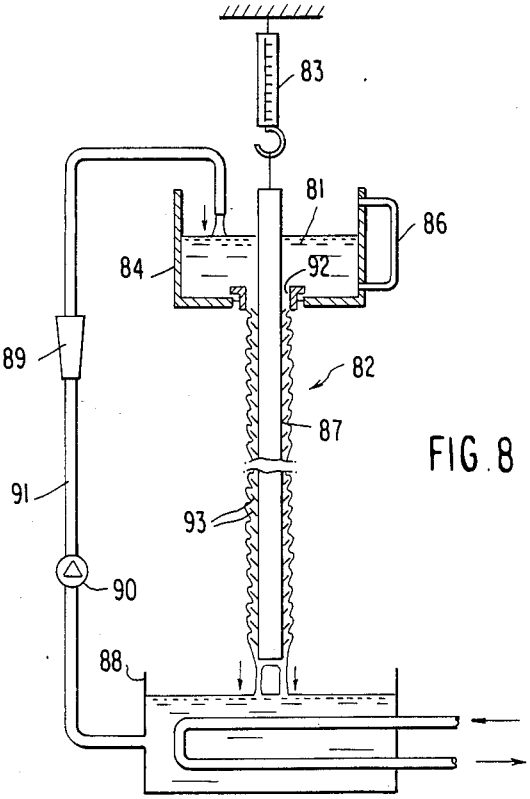
FIG. 8

HEAT AND MASS TRANSFER DEVICE

FIELD OF THE INVENTION

This invention relates to a heat and mass transfer device in which a solution is allowed to flow along the outer wall of a pipe or pipes for transmitting heat.

BACKGROUND OF THE INVENTION

In such a device, the heat is generated by absorbing a refrigerant vapor as a solvent (such as water) into a flowing high salt concentration solution such as a lithium bromide solution whereby heat is transmitted to a fluid which flows internally of the pipe or pipes. Alternatively heat is transmitted from a hot fluid flowing internally of the pipe or pipes to a solution which flows along the outside surface of the pipe wall to produce the vapor which surrounds the transmission pipes from the solution flowing down the external surface of the pipe or pipe outer wall.

FIG. 1 shows an example of a conventional device of this type wherein a cylindrical transmission pipe 11 has a spiral fins 12 attached to the outer surface or periphery 13 of the transmission pipe 11.

FIG. 2 shows a pipe 11 arranged vertically, in a heat and mass transfer device wherein a high salt concentration solution 14 is sprayed from a nozzle (not shown) against the pipes indicated generally at 11 permitting the solution to leak down along the outer surface 13 of the pipe wall with the wet heat produced by the solution absorbing vapor surrounding the pipes 11. The heat is transmitted through the pipe wall to the interior of the pipe and thus to the fluid flowing axially through the pipes 11.

FIGS. 3–7, inclusive, show another conventional, prior art heat and mass transfer device corresponding to Japanese Patent No. 59-19074 which is an improvement over the prior art shown in FIGS. 1 and 2. The device shown in FIGS. 3–7, inclusive, uses tooth fins 18 or alternatively needle fins (not shown) which are fixed rigidly onto the external surface of pipe 11 with the tooth fins at some angle to the vertical axis of the pipe and directed upwardly. The rate of transmitting heat in the pipe 11 is increased because the sprayed solution is dispersed more uniformly around the tooth fins (or the needle fins). The tooth fins 18 shown in FIG. 5 are preferably arranged so as to overlap in the radial direction and the relationship between the individual fins may be regular or irregular. The fins are preferably formed by slitting or cutting a sheet metal fin plate or strip P from one edge inwardly towards the other edge to form cuts C and by wrapping the strip P about the periphery of the pipe 11, with fins extending outwardly and upwardly. Upon spraying of the high salt concentration solution 14 onto the outside of the pipe 11 the solution drops by gravity down through the fins 181–185 by filling the space between the fins and the surface of the pipe 11 in the longitudinal direction and by spreading among the fins circumferentially as shown in FIG. 6.

The heat and mass transfer device, FIGS. 3–7, inclusive, has improved characteristics for absorbing the vapor surrounding the pipe and an increase in the rate of heat transmission. However, such conventional prior art heat and mass transfer devices have not been designed, to applicants' knowledge to maximize the ability of the high salt concentration solution to absorb vapor by optimizing the inclination angles for the fins and/or the pitch between succeeding fin plate pieces based on analysis of performance.

FIG. 8 is a schematic illustration of an apparatus for effecting the flow of solution relative to a vertically oriented pipe provided with fins and forming a heat and mass transfer device in accordance with the prior art. Such apparatus consists of a finned pipe indicated generally at 82 with a spring balance 83 for maintaining the pipe in vertical upright position with its lower end centered within a upwardly open thermostatic bath 88. An upper vessel 84 concentrically surrounds the upper end of the pipe 82 and pipe 82 extends through a central hole 92 within the bottom of the upper vessel 84. A pipe 91 leads from the thermostatic bath 88 upwardly and to one side of the pipe 82 for transferring liquid from the thermostatic bath 88 to the upper vessel 84. A pump 90 is within pipe 91 along with a flow meter 89. The circulating solution flows by gravity through the annuler gap between pipe 82 and the hole 92 within the upper vessel 84 and falls down along the outside of the pipe 82 and over the fins 93 carried thereby.

It is therefore an object of the present invention to provide an improved heat and mass transfer device based on solving the best configuration for the fins and for their spacing relative to each other along the exterior of a vertical pipe for such heat and mass transfer device.

SUMMARY OF THE INVENTION

In accomplishing that object, the present invention constitutes and improved a heat and mass transfer device comprising at least one vertically upright tubular pipe, a U-shaped folded metal fin strip twisted helically about the periphery of said tubular pipe consisting of first and second fin plate sections, a central base integrally joining said fin plate sections with said base being attached to the pipe periphery and wherein said first and second fin plate sections extend parallel to each other and terminate, remote from base in integral fins circumferentially flaring and angled upwardly at common angles within the range of 30°–80° to the axis of the pipe. The fins of said plate sections are spaced longitudinally from each other with respective fins of said first and second fin plates are spaced from each other by a distance S. Further, said folded metal fin strip is helically wrapped about said pipe such that the distance d between facing fins of adjacent turns of said folded metal fin strip is equal to at least twice the distances between the laterally spaced fins of respective fin plate sections of the same folded metal fin strip.

The first and second fins may comprise narrow, thin, rectangular teeth or may constitute needles.

BRIEF DESCRIPTION OF THE DRAWINGS

FIG. 1 is a side view of one form of a conventional finned pipe type heat and mass transfer device.

FIG. 2 is a vertical side elevational view of a portion of the conventional heat and mass transfer device of FIG. 1 with a high salt concentration solution flowing downwardly over the exterior of the pipe.

FIG. 3 is a side elevational view of a finned pipe of another conventional heat and mass transfer device.

FIG. 4 is a sectional view of the finned pipe of FIG. 3.

FIG. 5 is an enlarged, elevational view of a portion of the finned pipe of FIG. 3.

FIG. 6 is a side elevational view of the finned pipe of FIG. 1 under conditions where a heat exchange solution is flowing over the exterior of the pipe.

FIG. 7 is a plan view of a slotted sheet metal strip for forming heat transfer fins for the conventional fin pipe heat and mass transfer device of FIGS. 3–6, inclusive, prior to attaching it to the pipe thereof.

FIG. 8 is a schematic view of a heat and mass transfer device wherein a flow of a high salt concentration solution is effected about the exterior of the vertically oriented, finned pipe.

FIG. 13(*b*) is a sectional view of a portion of a finned pipe of a heat and mass transfer device in accordance with the second embodiment of the invention.

FIG. 13(*c*) is a sectional view of a portion of a finned pipe of a heat and mass transfer device forming yet a further embodiment of the invention.

DESCRIPTION OF THE PREFERRED EMBODIMENTS

Figure 9:
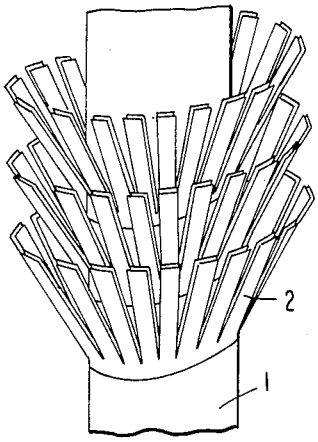
FIG. 9 is a perspective view of a finned pipe for a heat and mass transfer device forming a first embodiment of the present invention.
Figure 10:
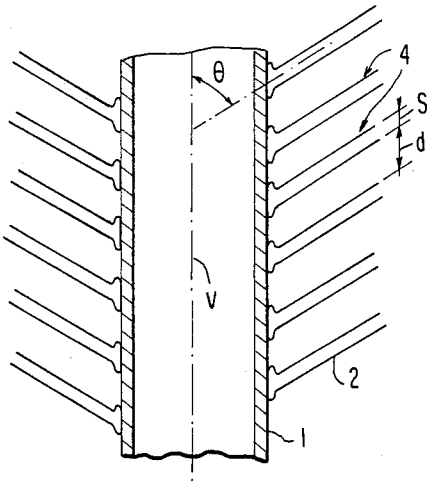
FIG. 10 is a vertical, sectional view of the finned pipe of FIG. 9.
Figure 11:
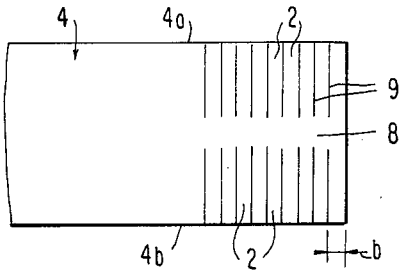
FIG. 11 is a plan view of a sheet metal strip during slitting to form a folded metal fin strip for attachment to a pipe of a heat and mass transfer device of FIG. 9.

In the description of the preferred embodiments, like elements bear like numerical designations. A first embodiment of the invention is illustrated in detail in FIGS. 9–12. A heat exchange fluid flows within the interior of a cylindrical pipe 1 having tooth fins 2 attached to the outer periphery of pipe 1 by twisting a sheet metal strip carrying the fins helically about the outer periphery of the tubular pipe 1. As seen in FIG. 11, the sheet metal strip 4 is slit from opposite sides or edges 4*a*, 4*b* to form parallel slits 9 which extend inwardly from the edges towards the center of the sheet metal strip 8 but stopping short thereof to define thin tooth fins 2. The sheet metal strip 4 is then bent at right angles at or inwardly of the inboard ends of the slits 9 to form a central, flat base 8 with vertically upright, parallel first fin plate section 41 and second fin plate section 42 extending parallel to each other, FIG. 12. The bottom part 5 of each of the plate sections may bulge outwardly above base 8 to facilitate the attachment of the fins 2 of the fin strip assembly indicated generally at 43 to the outer periphery of the pipe 1. The bottom part of base 8 may be adhesively fixed to the periphery of the pipe by epoxy resin. The fins 2 are bent to a suitable angle $\theta$ relative to the vertical axis of Pipe 1. For instance, in the embodiment of FIGS. 9–12 $\theta$ may be 48° to the vertical axis to the axis V to pipe 1. FIG. 10. Further, the fins 2 of the first fin plate section 41 are spaced from those of the second fin plate 42 by a distance or interval d. The first and second fin plates have a height H, the fins in turn have a lateral width b. The first and second fin plate sections are separated from each other by a distance S and thus the individual fins 2 for the first and second fin plate sections are spaced apart that distance. Also as seen in FIG. 10, in that embodiment the opposing fins 2 of the axially adjacent helical turns of the folded metal fin strip 4 are separated from each other by an interval or distance d.

Figure 13:
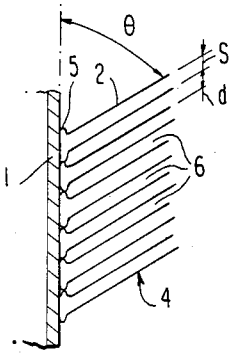
FIG. 13(*a*) is a sectional view of a portion of a finned pipe of a heat and mass transfer device according to a first embodiment of the invention.
Figure 13:
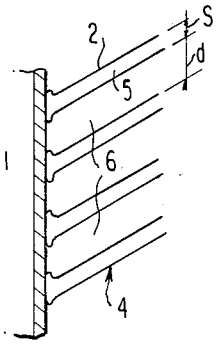
Figure 13:
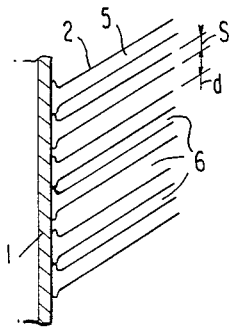

FIGS. 13(*a*)–13(*c*), inclusive, show three embodiments of the invention utilizing a pipe 1 and a folded metal fin strip 4 but with the helical wrapping of the fin strip creating various intervals d between the adjacent fins of succeeding turns of the helically wrapped folded metal fin strip 4. In FIG. 13(*a*), the folded metal fin strip 4 has turns which are tightly arranged and with the adjacent bulged bottom parts 5 in abutment with each other. Under such conditions, the distance d is slightly larger than distances opposing fins of adjacent turns.

FIGS. 13(*b*) shows an embodiment of the invention where, the folded metal fin strip 4 which is wrapped helically about pipe 1 has fins at the same angle $\theta$ equal to 48°, however in this case, the distance or interval d between adjacent turns of the folded fin strips and thus the opposing fins of one turn to another for the same folded fin strip, is approximately three times the distance S between the longitudinally opposing fins of the same turn.

In FIG. 13(*c*), a further variation is shown wherein two folded metal fin strip, tight to each other are wrapped helically so that a gap d exists between turns so that the distance d is larger than the distance s respective longitudinally spaced fins of the two strips, however in all other respects FIG. 13(*c*) is similar to the embodiments of FIGS. 13(*a*) and 13(*b*). In the case of FIG. 13(*c*), two folded fin strips are as close together as possible with the bulges at their bases 8 abutting but with a larger space d between the succeeding turns of the dual strips with the sequence continuing axially along the pipe 1. Other embodiments (not shown) are possible utilizing a larger number of folded metal fin strips 43 and in configurations where each fin strip is not limited to 2 fin plate sections.

Figure 14:
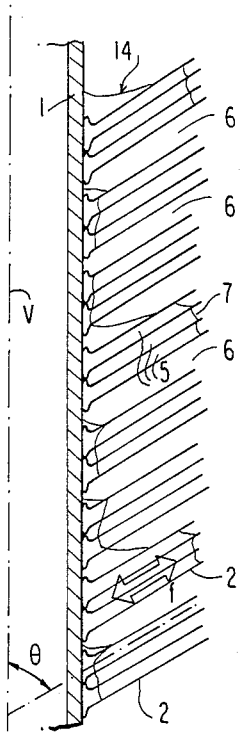
FIG. 14 is a vertical sectional view of a portion of a finned pipe of a heat and mass transfer device according to one embodiment of the invention illustrating the manner of flow of a high salt concentration solution along the exterior surface of the finned pipe where the fins are at an angle of approximately 60° to the axis of the vertical pipe.
Figure 15:
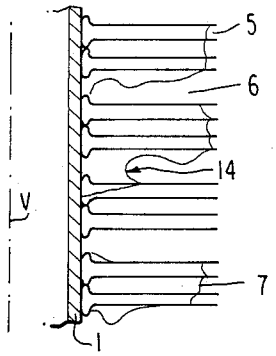
FIG. 15 is a vertical sectional view of a portion of a finned pipe of a heat and mass transfer device according to an embodiment of the invention where the angle of fins to the axis of the pipe is approximately 90° showing the nature of flow of the high salt concentration solution along the exterior of the finned pipe.

FIGS. 14 and 15 illustrate respectfully, the embodiment of FIG. 13(*c*) with angle $\theta$ equal to 48° in the case of FIG. 14 and in FIG. 15 $\theta$ is equal to 90°. In FIG. 14, when the gravity dropping high salt concentration solution 14 flows into a given space between fins, the volume of flowing solution increases within space 6 between the fins until a balance is reached where the solution tends to remain within the space 6 due to the surface tension and that where the weight of the solution tends to cause it to fall from that space into the succeeding space beneath the lower of the two fins defining such space 6. Thus after reaching the solution balancing point, the solution tends to fall by gravity into the succeeding space 6. In FIG. 14, several portions of the solution are maintained between the fins generally filling the spaces 6. It should be recognized that there is a periodic flow phenomena or pulsation in the flow of the solution and a change from solution maintenance between particular fins 2 to the dropping of the solution from that space 6 defined by those particular fins. It is necessary to produce the desired heat exchange effect to create the periodic flow pulsation or change from surface tension maintenance of the fluid between particular fins to that causing the solution to drop therefrom by breaking the surface tension of the solution filling the space between fins.

Figure 16:
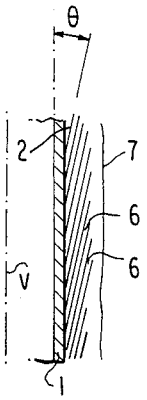
FIG. 16 is a vertical sectional view of a portion of a finned pipe of a heat and mass transfer device where the fins extend less than 30° to the axis of the vertical pipe.

FIG. 15 shows the distribution and maintenance of certain of the spaces filled with fluid as the fluid drops along the outside of the fin pipe 1 with the fins at right angles to the axis V of pipe 1. In contrast, if the angle $\theta$ is relatively steep as seen in FIG. 16, near 0°, the flow of the solution is effectively over the complete surface and along the outside of the fins 2. Under these conditions the solution is not distributed in terms of thick and thin film alternately along the pipe with the liquid in the fins and there is no pulsating along the fins. Indeed in FIG. 16 no thin film covering of the finned portion of the pipe 1 is experienced and the solution flow is relatively thick, as at 7, over the complete vertical length of the pipe 1 on the exterior on the finned pipe thereof.

Figure 19:
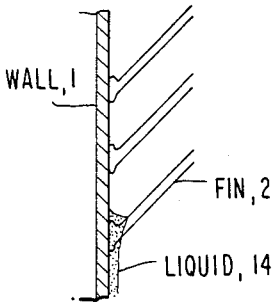
FIGS. 19(*a*)–19(*d*), inclusive, are vertical sectional views of a finned pipe of a heat and mass transfer device forming an embodiment of the invention for various frequencies of flow pulsation of solution from fin to fin under gravity flow on the exterior of the finned pipe.
Figure 19:
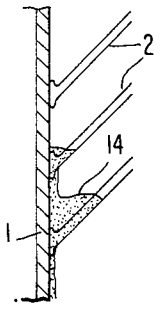
Figure 19:
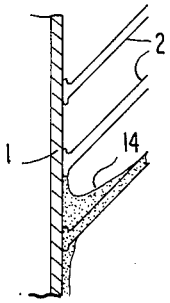
Figure 19:
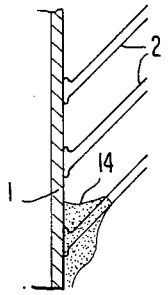

It has been determined that pulsation appears to take place under conditions where the balance between surface tension and gravity force acting on the contained or maintained liquid between the fins is lost, whereby the former maintains the film attachment state of the liquid while the latter breaks it. The profile of one cycle is described in detail below. Reference to FIGS. 19(*a*-)-19(*d*) shows that liquid, in flowing down from the top of the pipe 1 accumulates gradually between the fins, see FIGS. 19(*a*), 19(*b*). When the held liquid reaches a maximum value which maintains the balance, the flow of additional liquid causes liquid to gravity flow down in the direction of the tube axis, FIG. 19(*d*). It should be noted that the pulsation is not in the same phase along the tube length.

Further in the case where the fins 2 are at an angle of 90°, that is right angles, to the axis of the tube as shown in FIG. 14, it is difficult to create pulsation cycles owing to the difficulty in flowing of the solution into the space 6. In FIG. 16 where the angle of $\theta$ reaches a very acute angle as near 0°, the spaces 6 between the fins 2 are so narrow that the volume of solution filling the space 6 is not enough to produce cycles of dropping of the solution and the solution rides on the exterior of the fins, as at 7.

Based on these studies it may be appreciated that there exist a minimal angle ($\theta$ min) and a maximum angle ($\theta$ max) with respect to the angulation of the fins upwardly and outwardly of the pipe and relative to the axis of the pipe. Further, there exists a minimal interval d (min) of the fins along the pipe 1 to achieve cyclic pulsation dropping of the solution. By experimentation it has been ascertained that in using a copper tube of 12 mm (0.47 in.) outside diameter and utilizing varying number of pairs of fins for the folded fin strip, defined by respective fin plate sections, as set forth in Table 1 based on ethylene glco solution flowing on the outer surface of the heat and mass transfer device, pulsation of flow may or may not be achieved.

TABLE 1

| Designation of Pipe | Pairs of Fins | Smm (S inch) | dmm (d inch) | d/s | Hmm (H inch) | bmm (b inch) |
|---|---|---|---|---|---|---|
| S | 2 | 1 (0.039) | 4.10 (0.160) | 4.10 | | 1.20 (0.047) |
| D 1 | 4 | | 2.85 (0.112) | 2.85 | 11.25 (0.443) | |
| D 2 | 4 | | 1.75 (0.069) | 1.75 | | |

Figure 17:
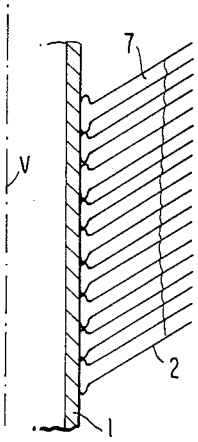
FIG. 17 is a vertical sectional view of a finned pipe of heat and mass transfer device according to an embodiment of the invention illustrating the nature of concentration of the solution on the exterior of the finned pipe.

In the conducting of the tests, where the interval or distance d was equal to 1.75 mm and the ratio of d/s was 1.75 for the pipe designated D 2, there was no oscrllation of the solution at all with the situation corresponding to that shown in FIG. 17. However, for the heat and mass transfer device utilizing pipes designated S or D1, where the interval or gap between the folded fin strips was equal to 4.10 and 2.85 mm respectively and where the ratio d/s was 4.10 and 2.285, respectively, an oscillation occurred in the movement of the solution under gravity influence over the finned exterior of the pipes.

Figure 18:
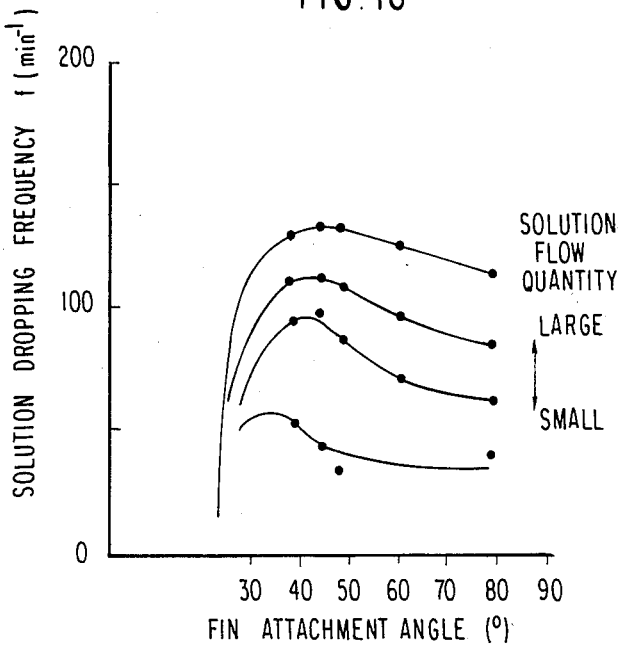
FIG. 18 is a graph showing the relationship between the solution dropping frequency for the solution applied to the exterior of the finned pipe for various attachment angles for the fins to the pipe exterior under large and small solution flow conditions.

Reference to FIG. 18 shows a graph illustrating the relationship between the attachment angles of the fins to the outer periphery of the pipe 1 in the various embodiments and the solution dropping frequency. In the plots, the ordinate is the solution dropping frequency (f per minute) and is plotted against the abscissa. (fin attachment angle in degrees). As may be seen, the frequency f increases with the quantity of solution applied to the exterior of the pipe by spraying etc. The solution dropping frequency increases whether the solution quantity is small or large for fin attachment angles of about 30° to 40° and above and while the frequency is relatively large in the fin attachment angle range from 30° to 80°, optimization occurs with fin angles of 35° to 65°. Where the fin angles are 30° or below or at an angle in excess of 80° to the axis of the pipe, the solution will not oscillate in its gravity induced movement over the finned pipe exterior.

The invention has particularly application to a heat exchanger, where, heat is generated by absorbing the vapor of a refrigerant (such as water) into the external flowing high salt concentration solution which heat is transmitted to a captured fluid flowing internally within a pipe 1. Table 2 set forth below shows typical solutions and refrigerant combinations for such heat and mass transfer devices employing the present invention.

TABLE 2

| Solution | Refrigerant |
|---|---|
| lithium bromide solution | Water |
| dimethyl formamide (DMF) | R22 |
| dimethyl formamide (DMF) | R21 |
| isobuthil acetate (IBA) | R22 |
| tetraethylene glycol (E-181) dimethyl ether | R22 |
| water | ammonium |

Figure 12:
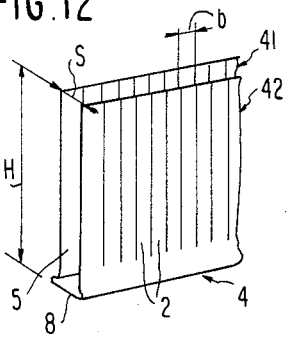
FIG. 12 is a perspective view of a portion of the folded metal fin strip forming a preferred embodiment of the invention.
Figure 20:
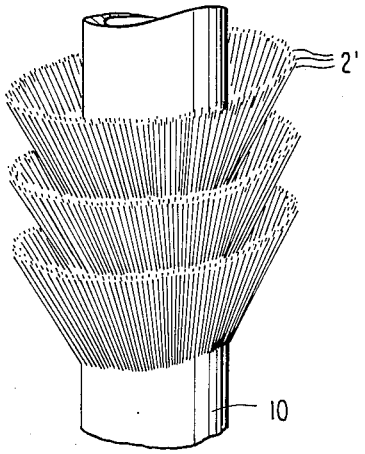
FIG. 20 is a perspective view of a finned pipe for a heat and mass transfer device forming yet another embodiment of the invention, where the fins are of needle form.

As mentioned previously, and as shown in FIG. 20, while the fins may comprise a sheet metal strip formed by cutting parallel slits within a sheet metal strip inwardly from opposite side edges thereof and folding the sides upwardly from an uncut middle portion (base) of the strip to form a folded fin strip, as per FIG. 12, the fins may alternatively be needle fins 2' fixed to the outer periphery of pipe 1 projecting upwardly and outwardly of the pipe periphery at an angle $\theta$ and in a helical or other array, in accordance with FIG. 20.

While the invention has been particularly shown and described with reference to preferred embodiments thereof, it will be understood by those skilled in the art that various changes in form and details may be made therein without departing from the spirit and scope of the invention.

What is claimed is:

1. A heat and mass transfer device for transmitting heat between a fluid flowing within a pipe and a solution flowing on the outside of the pipe which absorbs the vapor of a solvent in the vicinity of that solution or where, heat transmitted from a hot fluid flowing within the pipe to the solution flowing along the outside of the pipe produces a vapor from said solution which surrounds the pipe, said heat and mass transfer device comprising:

a. a pipe oriented vertically for effecting fluid flow therein;

b. at least two fin assemblies fixedly positioned on the outer periphery of said pipe, axially spaced from each other and each defined by at least two axially spaced series of circumferentially spaced fins fixed at one end to the periphery of said pipe and extending outwardly and upwardly at equal angles $\theta$ to the pipe axis and formed of heat conductive material, wherein the fins of each series extend parallel to each other, are spaced at a distance (s) from each other and wherein the fin assemblies are spaced longitudinally along the periphery of the pipe such that the longitudinally adjacent fins of respective fin assemblies are set at an interval (d) from each other; and wherein, $\theta$ ranges from about 30° to about 80° and wherein the distance d is at least 2 times the distance s;

c. means for applying a liquid to the outside of said pipe for flow vertically under gravity influence over said at least two fin assemblies; and d. means for flowing a fluid internally within said pipe and thereby effecting improved heat transfer between the internal fluid and the external liquid by periodic pulsation of the external liquid by periodic termination of the balance between surface tension on the liquid contained between the fins which maintains the film attachment state of the liquid and the gravity force acting on said contained liquid which breaks said surface tension.

2. The heat and mass transfer device as claimed in claim 1, wherein each of said fin assemblies comprises adjacent helical turns of a unitary sheet metal strip, which has slits at right angles to the longitudinal axis to the strip from opposite sides towards the center thereof, said slits terminate short of the center and said sides are bent upwardly into U-shape generally at right angles to the unslotted center portion to form opposed fin plates facing each other, and wherein said strip center portion forms a base, said base is fixed circumferentially to the outer periphery of said pipe with the fins radiating outwardly from said center portion.

3. The heat and mass transfer device as claimed in claim 1, wherein, each fin assembly comprises a pair of U-shaped, folded fin strips having unitary bases being bulged outwardly at their bases and having edges in edge abutting position at the periphery of said pipe.

4. The heat and mass transfer device as claimed in claim 1, wherein said fin assemblies comprise a continuous metal strip helically wrapped about the periphery of the pipe, and wherein, the distance d constitutes the pitch of the helically wrapped metal strip.

5. The heat and mass transfer device as claimed in claim 1, wherein, said first and second fins comprise needles.

6. The heat and mass transfer device as claimed in claim 1, wherein said first and second fins comprise thin, narrow, rectangular fin tooth strips of uniform width and length.

* * * * *